United States Patent [19]

Greding

[11] 4,288,044

[45] Sep. 8, 1981

[54] PAPER REEL SYNCHRONIZING SYSTEM

[75] Inventor: Robert Greding, Beaconsfield, Canada

[73] Assignee: Dominion Engineering Works Limited, Quebec, Canada

[21] Appl. No.: 94,448

[22] Filed: Nov. 15, 1979

[51] Int. Cl.[3] ..... B65H 23/02

[52] U.S. Cl. ..... 242/67.1 R; 242/75.2; 74/89.22

[58] Field of Search ..... 242/67.1 R, 75.1, 75.2, 242/75.3, 66, 67.2, 67.3, 67.4, 67.5, 65; 74/89.22, 89.21, 89.2; 187/20

[56] References Cited

U.S. PATENT DOCUMENTS 868,117 10/1907 Olney ..... 187/20

2,677,508 5/1954 Locke ..... 242/66

3,529,481 9/1970 Budzyn ..... 74/89.21

3,732,742 5/1973 Castaldi ..... 74/89.22

*Primary Examiner*—John M. Jillions

*Attorney, Agent, or Firm*—Raymond A. Eckersley

[57] ABSTRACT

A reel bar guides for a paper reeling machine include a pair of track-mounted spaced apart carriages on which the reel bar end bearings are respectively mounted, and a looped cable system interconnecting each end of each carriage with the other carriage, including guide pulleys to maintain the cable runs in tensioned free-running relation, whereby displacement of one carriage in a first direction along its respective track produces simultaneous displacement of the other carriage in the same direction along the other track.

1 Claim, 1 Drawing Figure

PAPER REEL SYNCHRONIZING SYSTEM

Figure 1:
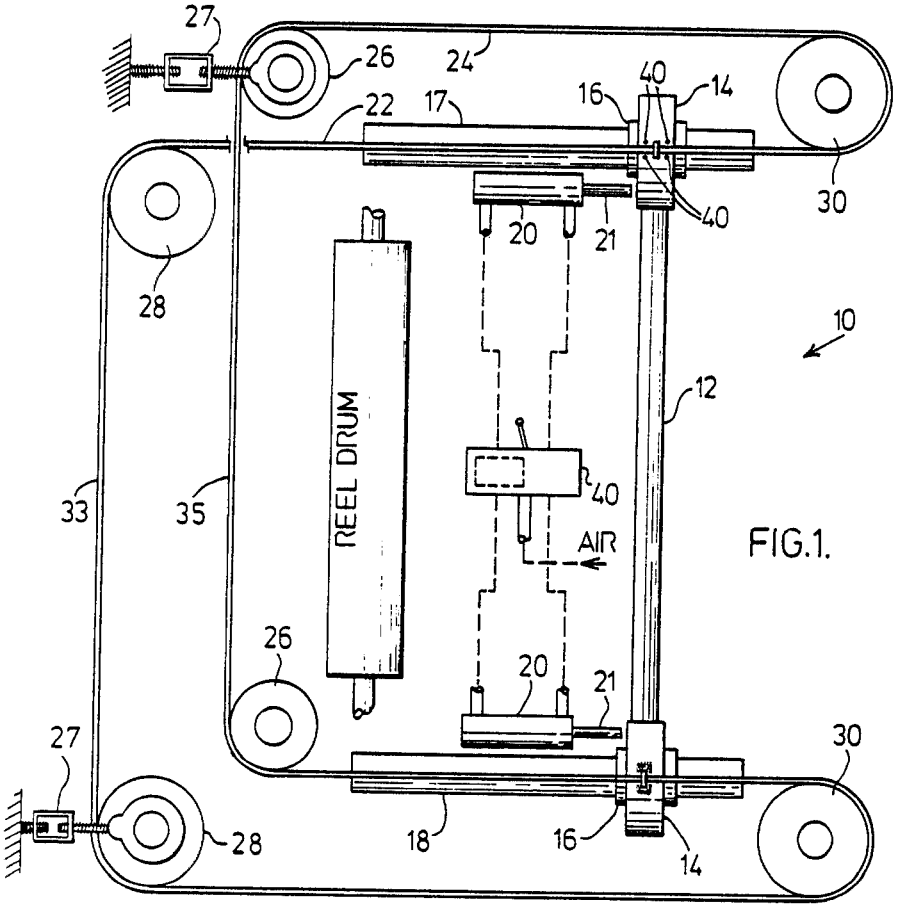

This invention is directed to paper winding machinery and in particular to a reel bar carriage arrangement to provide synchronized displacement of the ends of the reel bar along the supporting tracks thereof.

In the paper machine art, particularly in paper reeling, wherein the support of a reel bar is provided by movable bearings, the maintenance of the reel bar in parallel relation with the reel drum presents a continuing problem.

Various complex arrangements for solving this problem have been presented. The presently disclosed arrangement provides a low cost solution of classic simplicity.

The present arrangement provides a synchronizing system to provide synchronized displacement of a pair of spaced apart carriages for movement in predetermined directions along a pair of tracks, comprising flexible, substantially inextensible connection means extending in opposite directions from each of the carriages to provide displacement of each carriage in a first direction and the reverse direction respectively along the respective track, the connection means being connected to provide continuous interconnection therebetween, and guide means securing the flexible connection means in looped, continuously tensioned relation, whereby displacement of one carriage in one direction produces equal displacement of the other carriage in a corresponding direction along the other track.

Displacement of the carriage is produced by mover means connected to at least one of the carriages, for selective displacement of the carriage along the track.

In the subject embodiment the tracks are substantially parallel with each other.

Certain embodiments of the invention are described, reference being made to the accompanying diagramatic sketch representing a plan view of a portion of a winding machine incorporating the subject invention.

Referring to the drawing the reeling arrangement 10 comprises a removable reel bar 12 incorporating end bearings 14 each of which is detachably mounted on a carriage 16. Each carriage 16 is mounted on a track 17, 18, the tracks 17, 18 being parallel one with the other, located adjacent the reel drum.

Cylinder actuators 20 each has the piston portion 21 pinned to the respective carriage 16. The actuators 20 are usually pneumatic, for purposes of cleanliness, to prevent the contamination that hydraulic oil can produce.

Substantially inextensible cables 22, 24 interconnect the two carriages. On the illustrated top carriage, spaced stops 40 permit about one inch of lost motion in each direction, as indicated by the double ended arrow. Pairs of guide pulleys 26, 26, 28, 28 maintain general alignment of the cables 22, 24 with the carriages and the respective tracks 17, 18, while two or more vertically inclined pulleys 30 permit the positioning of the cable runs across the machine i.e. cable portions 33, 35, extending generally parallel with the axis of the reel drum.

The provision of tensioning means, illustrated as turn buckles 27 acting against two of the "horizontal" pulleys 26 in a sense to stretch the cables 22, 24, serves to maintain the cables in a pre-tensioned condition.

In the illustrated embodiment the respective actuators are shown as being double acting pneumatic actuators connected to an air supply by way of a manual control 40 having an intermediate null position, and being movable to the left, as illustrated to discharge the reel bar 12 rightwardly away from the reel drum, and vice versa.

Thus, in operation, during a winding operation the reel bar 12 is positioned in uniform pressing relation against the roll as it builds by the air pressure in the cylinders 20, and the lost motion in the cable attachment permits slight missalignment due to non-uniform paper gauge. Upon discharging the roll or returning the reel bar, the actuators 21 are substantially synchronized by the cable, to avoid significant skewing of reel bar 12.

What I claim as new and desire to secure by Letters Patent of the United States is:

1. In a paper reeling system having a rotatably mounted reel drum for reeling paper thereon, a removable reel bar for applying pressure against a roll being reeled on said drum and incorporating end bearings, each said bearing detachably mounted on a carriage; a rotatably mounted reel drum; a pair of tracks extending substantially normally to the drum in spaced apart relation, each having a said carriage mounted in sliding relation thereon; an air cylinder adjacent each track attached to a respective said carriage to displace the carriage along the track, including air admission control means for selectively admitting air simultaneously to each said air cylinder in an advancing or a retracting sense; mechanical synchronizing means interconnecting the two said carriages including substantially inextensible cable means looped in tensioned relation as an endless loop arranged to maintain the carriages in substantially mutually parallel relation, and lost motion means interconnecting said cable means and one said carriage to permit limited skewing of said reel bar relative to said drum in roll building operation.

* * * * *